United States Patent [19]

Saurenman

[11] 3,977,045

[45] Aug. 31, 1976

[54] STATIC CHARGE POSITIONING OF TEXTILE SLIVER IN ANGLED TUBULAR FEEDER

[76] Inventor: Donald G Saurenman, 6787 Worsham Drive, Whittier, Calif. 90602

[22] Filed: Dec. 6, 1974

[21] Appl. No.: 530,196

[52] U.S. Cl. ..... 19/159 R

[51] Int. Cl.[2] ..... B65H 54/80

[58] Field of Search ..... 19/157, 159 R, .41, 19/.35, 144; 57/157 AS; 317/2 C; 226/94

[56] References Cited

UNITED STATES PATENTS

| | | | |
|---|---|---|---|
| 2,231,324 | 2/1941 | Crompton, Jr. | 19/144 |
| 2,641,804 | 6/1953 | Klein | 19/.35 |
| 3,324,515 | 6/1967 | West | 19/159 R |

*Primary Examiner*—Dorsey Newton
*Attorney, Agent, or Firm*—William W. Haefliger

[57] ABSTRACT

A textile sliver is fed through a tube and into a drum to coil therein, and the tube and drum are relatively rotated about an axis; the tube extends at an angle to the axis to deliver the sliver to coil within the drum; the sliver has a static charge as it enters the tube, and the method includes the steps:

a. imparting to the tube inner wall a static charge of a polarity the same as said charge on the sliver thereby to effect a repulsion of the sliver from said inner wall, and b. continuing said feeding of the sliver through said tube as the tube rotates about said axis.

5 Claims, 4 Drawing Figures

STATIC CHARGE POSITIONING OF TEXTILE SLIVER IN ANGLED TUBULAR FEEDER

BACKGROUND OF THE INVENTION

This invention relates generally to processing of textile slivers or yarns; more particularly, it concerns a solution to certain problems which arise when slivers are fed to drums for storage in coiled configuration.

Processing of textiles such as cotton, wool, synthetic fibers or combinations thereof commonly involves carding and roving steps, between which the textile sliver is fed to a drum for coiling and later removal. Coiling is accomplished by guiding the traveling sliver in a rotary path as it enters the drum; however, it is found that the sliver may tend to "hang up" or jam in the guide, as may be due to build-up of static charge on sliver and/or mechanical deflection of the sliver by guide surfaces. Also, desirable coiling is obstructed. As a consequence, time, effort and expense are frequently involved in freeing the sliver from such jamming or binding in the equipment.

SUMMARY OF THE INVENTION

It is a major object of the invention to provide method and apparatus for eliminating or preventing the above described problems and their adverse consequences. The apparatus environment of the invention includes a drum to receive the sliver to coil therein, a guide tube rotatable relative to the drum to produce the coil, the tube being angled relative to the axis of relative rotation, and the sliver entering the tube having a static charge of predetermined polarity. In accordance with the invention, the method involves the steps:

a. imparting to the tube inner wall a static charge of a polarity the same as said charge on the sliver thereby to effect a repulsion of the sliver from said inner wall, and b. continuing said feeding of the sliver through said tube as the tube rotates about said axis.

As a result, the sliver tends to remain out of contact with the coil forming tube while it passes through same, preventing jamming.

Means to impart the static charge to the tube advantageously includes a conductive ring attached to the conductive tube, to rotate therewith; a follower engaging the rotating ring and a source of DC voltage connected with the follower. Further, the tube may be carried by a rotating head for the drum, and insulated therefrom as will be described.

These and other objects and advantages of the invention, as well as the details of an illustrative embodiment will be more fully understood from the following description and drawings, in which:

DRAWING DESCRIPTION

DETAILED DESCRIPTION

Figure 1:
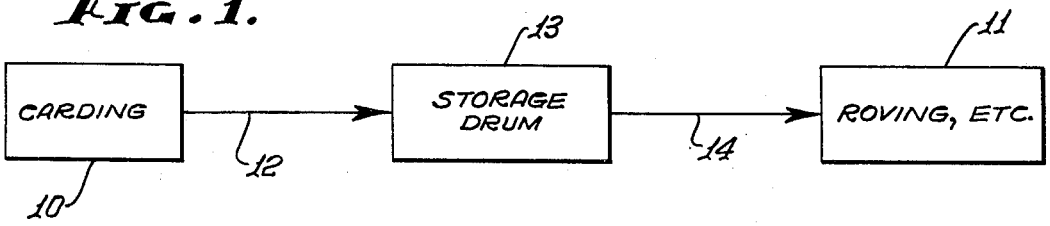
FIG. 1 is a flow diagram.
Figure 3:
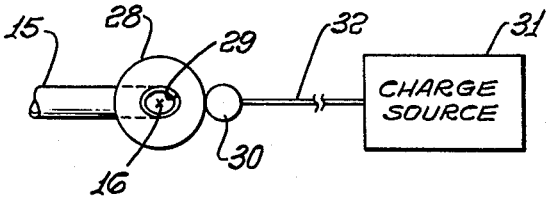
FIG. 3 is a plan view taken on lines 3—3 of FIG. 2.
Figure 2:
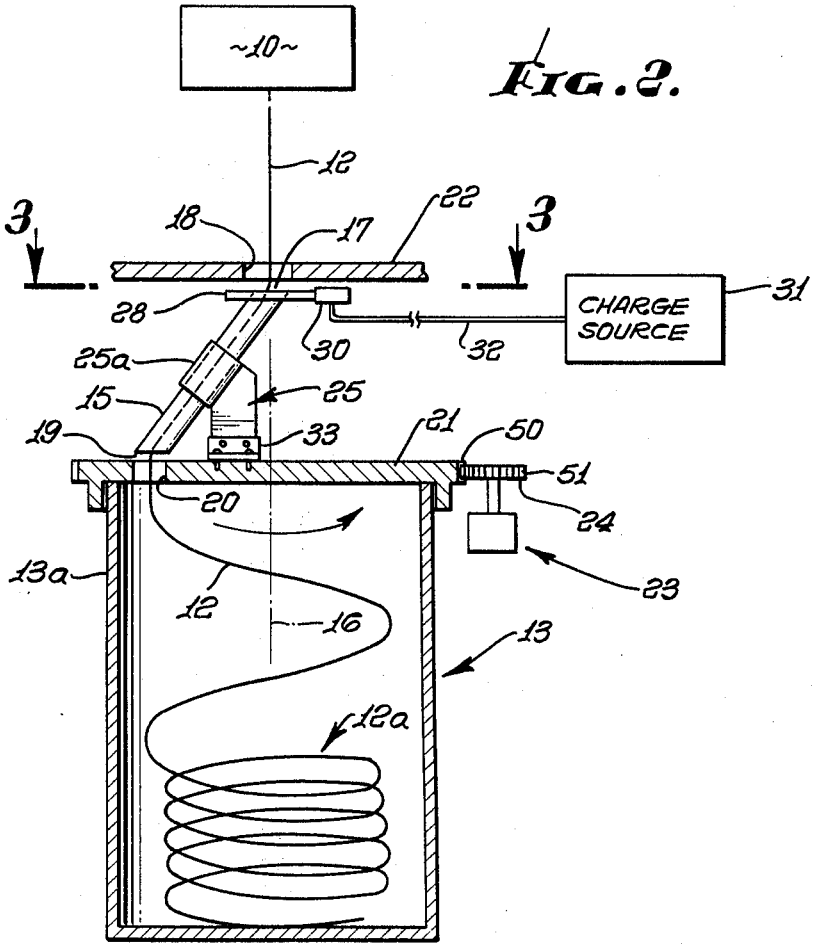
FIG. 2 is a vertical elevation taken through equipment embodying the invention.

Referring first to FIG. 1, between the carding and roving steps indicated at 10 and 11, cotton in sliver or yarn form is passed at 12 to a storage drum 13, wherein the sliver is coiled for removal and delivery at 14 to the roving equipment. Turning to FIG. 2, the upright drum 13 receives the sliver 12 via an electrically conductive metallic tube 15 angled downwardly and laterally from the drum vertical axis 16 so that as the tube is rotated about axis 16 relative to the drum, the sliver will form coils indicated at **12*a* within the drum. This facilitates later sliver removal from the drum and delivery to the roving equipment. In this regard, the drum could be rotated about axis 16 relative to the tube, whereby relative drum and tube rotation is the requirement. Note that the sliver 12 enters the tube at 17 via an opening 18 in a top plate 22, that opening and the tube entrance being at the axis 16; also, the sliver leaves the angled tube at exit 19, passing through an opening 20 in a head plate 21 overlying the interior of the drum. Plate 21 typically is rotated with tube 15 about axis 16, a suitable peripheral drive for the plate being indicated at 23. For example, the plate may have peripheral teeth meshing with teeth on a drive gear 24. A bracket 25 attached to the plate carries the tube at 25*a* to extend at the angle shown, so that the sliver enters the drum closer to the drum wall 13*a* than to axis 16**.

The textile (such as cotton) sliver entering the tube 15 typically possesses a static charge imparted to it as a result of mechanical friction as during the carding step at 10, or by roller transmission of the sliver traveling to the tube 15. Accordingly, means to produce a static charge in the sliver is present.

In accordance with the invention, means is provided to impart to the tube inner wall, as for example via the tube, a static charge of the same polarity as that the charge on the sliver, thereby to effect repulsion of the sliver from the tube inner wall as the sliver travels endwise through the tube. Accordingly, the sliver is directed or guided to freely travel endwise and angularly, toward the inner wall of the drum, by gravity and by the effect of static electricity; also, the sliver is prevented from jamming in the tube 15 as it travels through it, as the sliver tends to remain out of contact with the tube.

Such means may, with unusual advantage include a conductive ring or disc 28 attached to the upper end of the tube to rotate with the tube, the ring or disc containing an elliptical opening 29 to receive the electrically conductive tube so that the disc is normal to the axis 16 and the center of the disc is at that axis; further, a conductive follower, such as roller 30, engages the ring periphery as the ring rotates, and a source of DC voltage 31 is connected at 32 with the follower so that static electrical charge flows via the follower and ring to the tube to charge the inner wall of same.

Further, the bracket 25 may include an electrically insulative connection at 33 to the head plate, whereby static electrical charge is presented from dissipating by flow to that plate.

The teeth on the plate 21 and on the gear 24 are indicated at 50 and 51.

Figure 4:
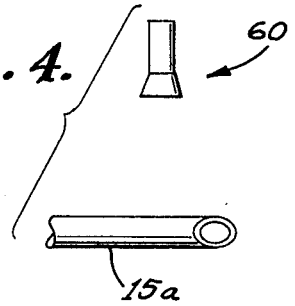
FIG. 4 is a plan view of a modification.

Typically, the DC voltage applied to the tube will lie within the range 5,000 volts to 20,000 volts, for best results. Another means to apply a static charge to the tube 15 consists of an ion gun as described in U.S. Pat. No. 3,308,344 to Smith and Korkos. One such gun is indicated at 60 in FIG. 4, the tube indicated at 15a.

I claim:

1. In the method of feeding a textile sliver into a drum to coil therein, and wherein the sliver is fed through a tube, the tube and drum relatively rotated about an axis, the tube extending at an angle to said axis to deliver the sliver to coil within the drum, the sliver entering the tube having a static electrical charge of determinable polarity, said method including the steps a. imparting to the tube inner wall a sufficient static charge of a polarity the same as said charge on the sliver thereby to effect a repulsion of the sliver from said inner wall as the sliver travels completely through the tube, and b. continuing said feeding of the sliver through said tube as the tube rotates about said axis.

2. The method of claim 1 wherein said sliver consists of cotton.

3. In apparatus for feeding a textile sliver into a drum to coil therein, and including a tube, the tube and drum relatively rotating about an axis, the tube extending at an angle to said axis to deliver the sliver for coiling in the drum, the sliver entering the tube having a static electrical charge of determinable polarity, the improvement which comprises, a. means for imparting to the tube inner wall a static charge of a polarity the same as said charge on the sliver, thereby to effect a repulsion of the sliver from said inner wall as the sliver travels through the tube, b. said axis extending generally vertically and generally coaxially with the drum and said tube rotating, about said axis and relative to the drum, and c. said means including a conductive ring on the tube near the upper end thereof to rotate with the tube, a conductive follower engaging said ring, and a source of voltage of said polarity electrically connected with said follower.

4. The improvement of claim 3 including a head plate overlying the upper interior of the drum, means mounting the tube on said plate, and means rotating the plate about said axis.

5. The improvement of claim 4 wherein said means mounting the tube on said plate includes a bracket electrically insulating the tube from the head plate.

* * * * *